US006469446B1

(12) United States Patent
Stockwald

(10) Patent No.: US 6,469,446 B1
(45) Date of Patent: Oct. 22, 2002

(54) MERCURY-FREE METAL HALIDE LAMP

(75) Inventor: Klaus Stockwald, Munich (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 286 days.

(21) Appl. No.: 09/631,841

(22) Filed: Aug. 3, 2000

(30) Foreign Application Priority Data

Aug. 10, 1999 (DE) ..... 199 37 312

(51) Int. Cl.[7] ..... H01J 61/12
(52) U.S. Cl. ..... 313/638; 313/570; 313/643
(58) Field of Search ..... 313/638, 572, 313/570, 637, 643, 640, 25

(56) References Cited

U.S. PATENT DOCUMENTS 3,758,805 A * 9/1973 Geller et al. ..... 313/638
5,814,944 A * 9/1998 Saito et al. ..... 313/638

FOREIGN PATENT DOCUMENTS

DE 19731168 1/1999 ..... H01J/61/18
WO 98/45872 10/1998 ..... H01J/61/18

* cited by examiner

*Primary Examiner*—Ashok Patel
(74) *Attorney, Agent, or Firm*—William H. McNeill

(57) ABSTRACT

Mercury-free metal halide lamp with a warm white luminous color, the fill of which comprises the following components: an inert gas which acts as a buffer gas; a first group of metal halides (MH), the boiling point of which is above 1000° C. (preferably above 1150° C.), the first group comprising at least Dy and Ca used simultaneously as metals, and the molar ratio of the two metal halides Ca-MH:Dy-MH being between 0.1 and 10; these are components with a low volatility which are present in saturated form; a second group of metal halides, the boiling point of which is below 1000° C. (preferably below 900° C.), the second group comprising at least one of the elements In, Zn, Hf, Zr as metals; these are volatile components which are mostly present in unsaturated form; the total fill quantity of the first group of metal halides being between 5 and 100 $\mu$mol/cm$^3$; the total fill quantity of the second group of metal halides being between 1 and 50 $\mu$mol/cm$^3$; and the color temperature being between 2700 and 3500 K; the general color rendering index being at least Ra=90, while at the same time the red rendering index is at least R9=60.

11 Claims, 6 Drawing Sheets

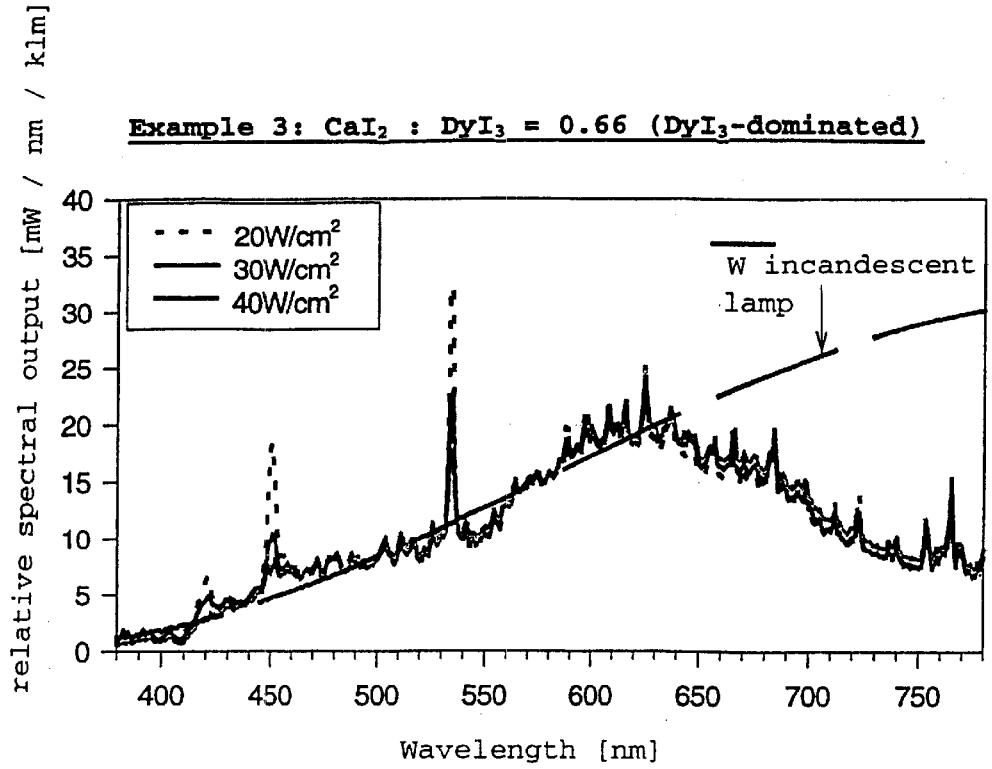
Figur 8
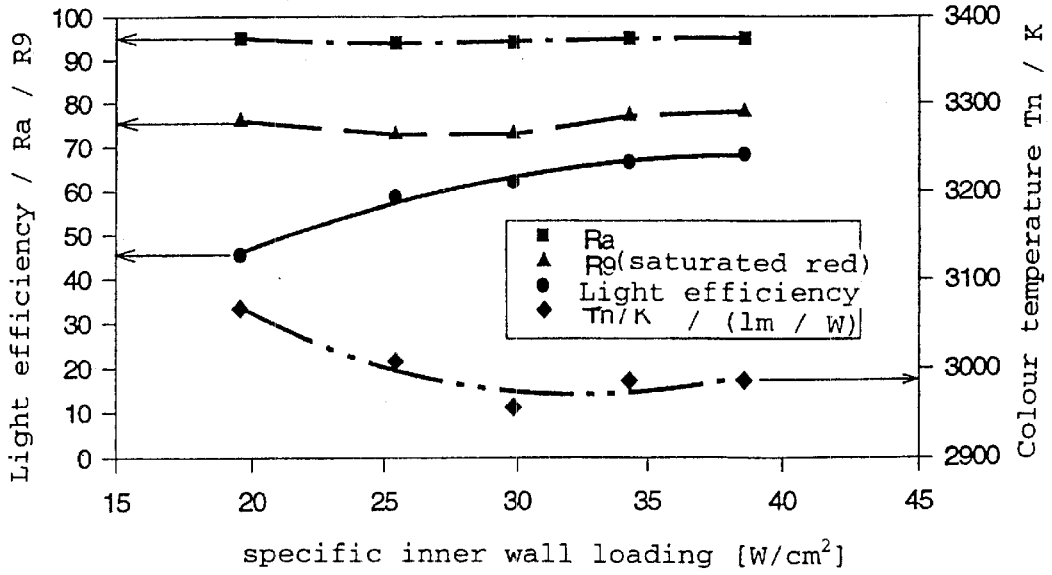
Figur 9

MERCURY-FREE METAL HALIDE LAMP

TECHNICAL FOELD

The invention relates to a mercury-free metal halide lamp according to the preamble of Claim 1. It relates in particular to lamps for the luminous colour warm white (WDL) for general illumination, which in particular is dimmable.

PRIOR ART

DE-A 197 31 168 has already disclosed a mercury-free metal halide lamp which uses two groups of metal halides, namely voltage generators, which primarily take over the role of the mercury, and light generators, in particular rare-earth elements. Therefore, warm white luminous colours of around 3500 K are desired. However, the red reproduction remains unsatisfactory, which is controlled by adding metal halides of Dy or Al. Similar fill systems are also described in WO 99/05699 and EP-A-833,160.

WO 98/45872 describes a mercury-containing metal halide lamp, the fill of which essentially contains Na and Tl-containing metal halides. In addition there are Dy metal halides and Ca metal halides. This fill is aimed at a neutral white luminous colour of 3900 to 4200 K.

When producing warm white and neutral white luminous colours, the use of sodium is disadvantageous, since it diffuses readily due to its small ionic radius.

DESCRIPTION OF THE INVENTION

The object of the present invention is to provide a metal halide lamp according to the preamble of Claim 1 which not only does not contain any mercury, for environmental reasons, but also completely or as far as possible avoids the use of sodium, in order to bypass the associated well-known difficulties. In particular, this affects the construction of lamps which are capped on one side (problem of photoionization).

This object is achieved by means of the characterizing features of Claim 1. Particularly advantageous configurations are given in the dependent claims.

According to the invention, a mercury-free metal halide lamp with a warm white luminous colour and a high colour rendering index Ra is proposed, the lamp comprising a discharge vessel into which electrodes are introduced in a vacuum-tight manner and with an ionizable fill in the discharge vessel. The fill comprises the following components: an inert gas which acts as a buffer gas, a first group of metal halides (MH), the boiling point of which is over 1000° C. (preferably above 1150° C.), the first group comprising at least Dy and Ca used simultaneously as metals, and the molar ratio of the two metal halides Ca-MH:Dy-MH being between 0.1 and 10, preferably between 0.2 and 5; these are components with a low volatility which are present in saturated form; a second group of metal halides, the boiling point of which is below 1000° C. (preferably below 900° C.), the second group comprising at least one of the elements In, Zn, Hf, Zr as metals; these are volatile components which are mostly present in unsaturated form; the total fill quantity of the first group of metal halides being between 5 and 100 $\mu$mol/cm$^3$; the total fill quantity of the second group of metal halides being between 1 and 50 $\mu$mol/cm$^3$; the colour temperature being between 2700 and 3500 K; the general colour rendering index being at least Ra=90, while at the same time the red rendering index is at least R9=60.

Preferably, the molar ratio of the two metal halides Ca-MH:Dy-MH is between 0.3 and 4. The second group preferably additionally comprises a metal halide of Tl in an amount of up to 30 $\mu$mol/cm$^3$, preferably 5 to 25 $\mu$mol/cm$^3$.

Furthermore, the first group may also include a metal halide of Na in a proportion of up to 30 mol %, preferably of at most 5 mol %, of the total quantity.

Preferably, the first group additionally comprises a metal halide of Cs in an amount of up to 40 $\mu$mol/cm$^3$, preferably 5 to 30 $\mu$mol/cm$^3$. Moreover, the cold filling pressure of the inert gas is advantageously between 100 and 10,000 mbar.

The members of the second group may additionally be added as metals in a proportion of up to 30 mol %. Moreover, at least one elemental metal or a metal halide of the metals Al, Ga, Sn, Mg, Mn, Sb, Bi, Sc may additionally be added to the second group, specifically in total in an additional proportion of up to 40 mol %.

Furthermore, at least one metal halide of the metals Sr, Ba, Li and/or the rare-earth elements may additionally be added to the first group, specifically in total in an additional proportion of up to 30 mol %.

Preferably, the discharge vessel is ceramic and has a typical ratio of the maximum internal longitudinal/lateral dimensions of at most 3.5.

Advantageously, the dimensioning of the inner wall surface is selected in such a way that, in operation, an internal wall loading of 10 to 60 W/cm$^2$ prevails.

The Hg-free fill is essentially an Na-depleted fill (preferably at most 5 mol % Na halide in the fill proportion with a boiling point of >1000° C.). Its composition is selected in such a way that at least Dy halide and Ca halide are included as fill constituents in the proportion of the fill substances with a boiling point of >1000° C., and that at least one metal halide MH with a boiling point of <1000° C. which is selected from the group In, Zn, Hf, Zr is included.

Particularly if the ratio Ca-MH/Dy-MH is >2 (in particular >4), it may be advantageous to add further metal halides to the fill, preferably the lanthanides listed below, in a proportion of up to 25 mol %, in order to compensate for the overhang in the red spectral region, caused by the $CaI_2$ content.

The total fill quantity of the first group in the discharge vessel is to amount to $CaX_2+DyX_3$=5–100 $\mu$mol/ccm (X is any desired halide selected from I, Br and Cl). Furthermore, the total fill quantity of the second group, relating to metal halides $MeX_n$ of the metals In, Zn, Hf, Zr is in total to be $MeX_n$=1–50 $\mu$mol/cm$^3$. If this parameter is selected at a lower level, the voltage gradient is below 50 V/cm, which is not practical.

Preferably, the addition of Tl–MH is in the range TlX= 5–30 $\mu$mol/ccm. The optimum quantity is to be selected as a function of other constituents in order to achieve the smallest possible deviation from the Planckian locus.

The spectral emission of the light source is in the warm white spectral region between 2700 K and 3500 K, and the general colour rendering index is preferably Ra>90, the red rendering index of saturated red being R9>60.

A particularly noteworthy feature of the present invention is that excellent constancy of the colour rendering is maintained even when the lamp is dimmed to approx. 50% of the lamp output. Previous fills were unsuitable for dimming. This is due to the balanced mix between Dy and Ca in combination with the possibility of enriching the Ca (and if appropriate also Cs) in the vapour phase by molecule formation (formation of complexes). This mechanism is particularly effective in mercury-free fills. As a result, the output is made independent of the spectral emission distribution in the visible spectral region, corresponding to an excellent dimmability.

The lamp fill may contain Cs halide in the fill constituent of the fill substances with a boiling point of >1000° C., in a mol % concentration of preferably between 10–50%, the total amount of the CsX typically being between 5–40 $\mu$mol/cm$^3$. This is because CsX improves the arc stability and increases the light efficiency.

In addition, the lamp fill may contain at least one metal halide with a boiling point of <1000° C. which is derived from the group Al, Ga, Sn, Mg, Mn, Sb, Bi, Sc. These substances can be added to the mixture in order to precisely set the voltage; some substances are also suitable for influencing the spectral emission distribution.

In a further embodiment, the lamp fill may additionally contain at least one elemental metal from the group Tl, In, Zn, Al, Ga, Sn, Mg, Mn, Sb, Bi, Sc, the fill quantity lying in the range between 0.5–50 $\mu$mol/cm$^3$. These substances can be added to the mixture in order to improve the electrical performance, for example to minimize restarting peaks.

The optional proportion of Na halide may amount to up to 30 mol % of the proportion of the fill constituents which have a boiling point of >1000° C. Although NaI typically impairs the dimming performance or constancy of the colour rendering, it may also be added in order to increase the light efficiency.

In a further preferred embodiment, at least one halide of the lanthanides and from the group Sr and Ba and Li may be included in the fill proportion with a boiling point of >1000° C., typically in a molar concentration of up to 35 mol %. These substances are added to the mixture in order to optimize the spectral distribution in the visual spectral region, e.g.: Sr, Ba and Li for further improvement of the emission in the red spectral region, lanthanides in the blue spectral region and green spectral region.

Preferably, the ionizable fill comprises at least one inert gas (Ar, Kr, Xe) with a cold filling pressure of 100–10,000 mbar. An extended service life is in particular possible with a cold filling pressure of typically more than 500 mbar Ar. Below 100 mbar, electrode loading is too high during the starting phase of the lamp, leading to a poor maintenance performance.

FIGURES

The invention is to be explained in more detail below with reference to a number of exemplary embodiments. In the drawing:

FIG. 1 shows a metal halide lamp with a ceramic discharge vessel;

FIG. 2 shows a spectrum of a metal halide lamp;

FIG. 3 shows an illustration of the Ra, R9 and the colour temperature as a function of the dimming level for the first exemplary embodiment;

FIG. 4 shows the colour coordinates as a function of the dimming level for the first exemplary embodiment;

FIG. 5 shows a second exemplary embodiment of a spectrum of a metal halide lamp;

FIG. 6 shows an illustration of the Ra, R9 and the colour temperature as a function of the dimming level for the second exemplary embodiment;

FIG. 7 shows the colour coordinates as a function of the dimming level for the first exemplary embodiment;

FIG. 8 shows a third exemplary embodiment of a spectrum of a metal halide lamp;

FIG. 9 shows an illustration of the Ra, R9 and the colour temperature as a function of the dimming level for the third exemplary embodiment;

FIG. 10 shows the colour coordinates as a function of the dimming level for the third exemplary embodiment.

Figure 1:
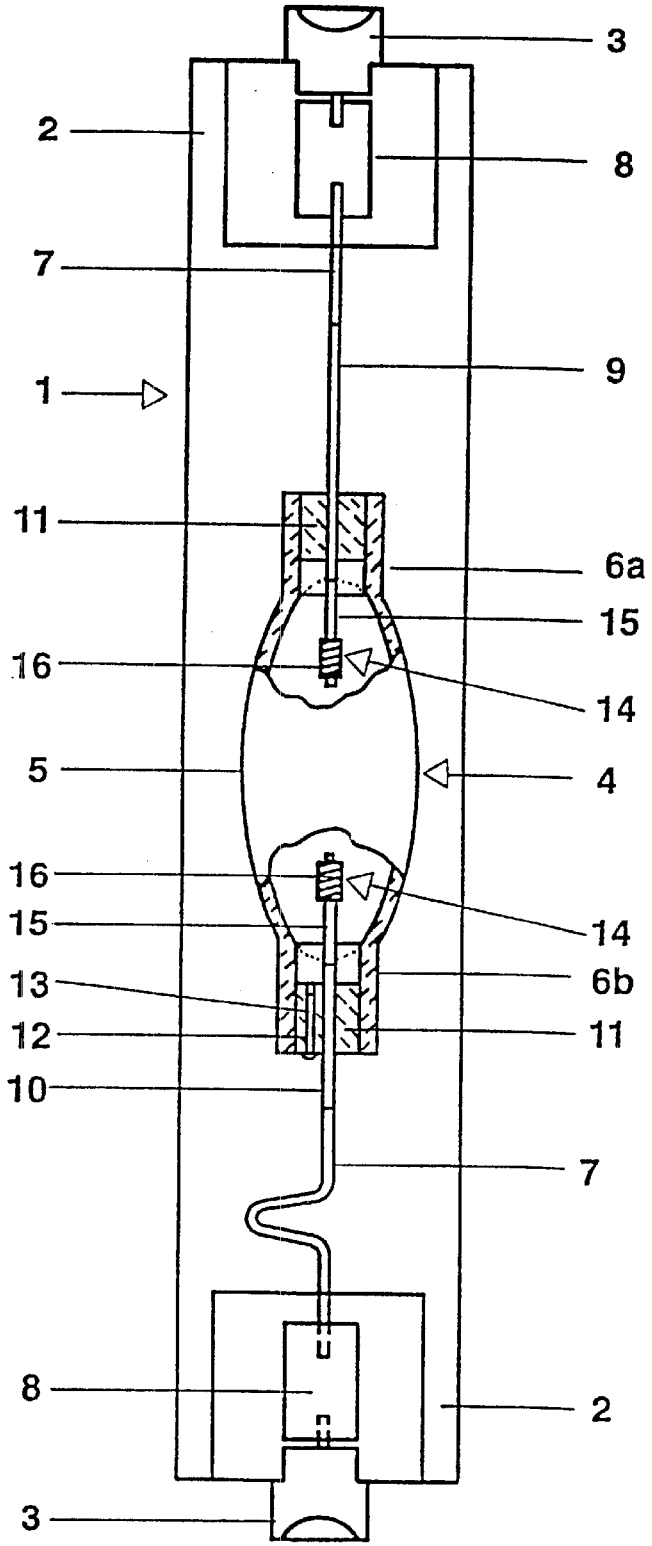
FIG. 1 diagrammatically depicts a metal halide lamp with an output of 70 W. It comprises a cylindrical outer bulb 1 which defines a lamp axis, is made from quartz glass and which is pinched (2) and capped (3) on two sides. The axially arranged discharge vessel 4 made from $Al_2O_3$ ceramic forms an ellipsoid and bulges out in the centre 5 while having two cylindrical ends 6*a* and 6*b*. However, it may also be cylindrical with elongate capillary tubes as stoppers. The discharge vessel is held in the outer bulb 1 by means of two supply conductors 7 which are connected to the cap parts 3 via foils 8. The supply conductors 7 are welded to lead-throughs 9, 10 which are each fitted in an end stopper 11 at the end of the discharge vessel.

The lead-throughs 9, 10 are, for example, molybdenum pins. Both lead-throughs 9, 10 project on both sides at the stopper 11 and on the discharge side hold electrodes 14, comprising an electrode shaft 15 made from tungsten and a coil 16 which has been pushed on at the discharge-side end. The lead-through 9, 10 is in each case butt-welded to the electrode shaft 15 and to the outer supply conductor 7.

The end stoppers 11 essentially comprise a cermet which is known per se with the ceramic component $Al_2O_3$ and the metallic component tungsten or molybdenum.

Moreover, at the second end 6*b* an axially parallel hole 12 is provided in the stopper 11, serving to evacuate and fill the discharge vessel in a manner known per se. This hole 12 is closed off by means of a pin 13 after filling. In principle, however, any other known design of the ceramic discharge vessel and for the closure technique may be selected.

The fill of the discharge vessel comprises an inert firing gas/buffer gas, in this case argon with a 250 mbar cold filling pressure, and various additions of metal halides.

Three examples of the fills according to the invention are shown in Table 1. In addition, the last two columns show the boiling points of the metal halides. In all cases, the elliptically shaped ceramic discharge vessel has an internal volume of 0.32 cm$^3$ and an inner surface area of 2.35 cm$^2$ with an arc length of 9 mm.

Figure 2:
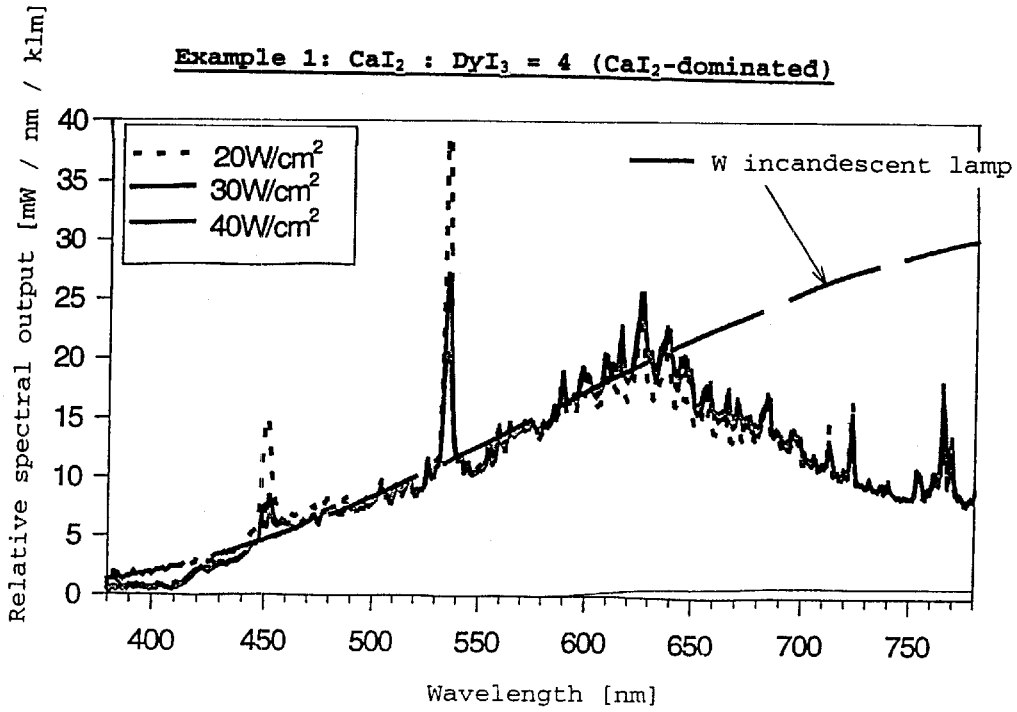

In the first exemplary embodiment, the operating voltage was approximately 60 V. The molar ratio CaMH:DyMH is in this case 60:15=4.0. It was therefore possible to achieve a 70 W WDL metal halide lamp, the emission spectrum of which is dominated by the $CaI_2$-bands (FIG. 2). They are in the red spectral region between 626 and 642 nm.

TABLE 1

| Metal halides of group 1 | Proportion formed by group 1 (mol %) | Absolute proportion (in $\mu$mol) | Metal halides of group 2 | Proportion formed by group 2 (mol %) | Absolute proportion (in $\mu$mol) | Compound | Boiling point (in ° C.) |
|---|---|---|---|---|---|---|---|
| 1st exemplary embodiment: | | | | | | From second group | |
| InBr | 18 | 1.4 | CsI | 25.0 | 3.1 | InBr | 677 |
| $InBr_3$ | 27 | 2.1 | $DyI_3$ | 15.0 | 1.9 | InI | 726 |
| $HfBr_4$ | 16 | 1.2 | $CaI_2$ | 60.0 | 7.4 | $InBr_3$ | 500 |
| TII | 39 | 3.0 | | | | $HfBr_4$ | 322 |
| | | | | | | TII | 823 |
| 2nd exemplary embodiment: | | | | | | From first group | |
| InI | 64 | 4.1 | NaI | 21.7 | 3.4 | CsI | 1280 |
| $HfBr_4$ | 22 | 1.4 | $TmI_3$ | 5.3 | 0.8 | $TmI_3$ | 1260 |
| TII | 14 | 0.9 | $DyI_3$ | 28.8 | 4.5 | $DyI_3$ | 1320 |
| | | | $HoI_3$ | 5.3 | 0.8 | $HoI_3$ | 1300 |
| | | | $CaI_2$ | 38.9 | 6.1 | $CaI_2$ | 1230 |
| | | | | | | NaI | 1304 |
| 3rd exemplary embodiment: | | | | | | | |
| InBr | 51.5 | 3.8 | CsI | 25.0 | 3.1 | | |
| $HfBr_4$ | 20.1 | 1.5 | $DyI_3$ | 45.0 | 5.7 | | |
| TII | 28.3 | 2.1 | $CaI_2$ | 30.0 | 3.8 | | |

Figure 3:
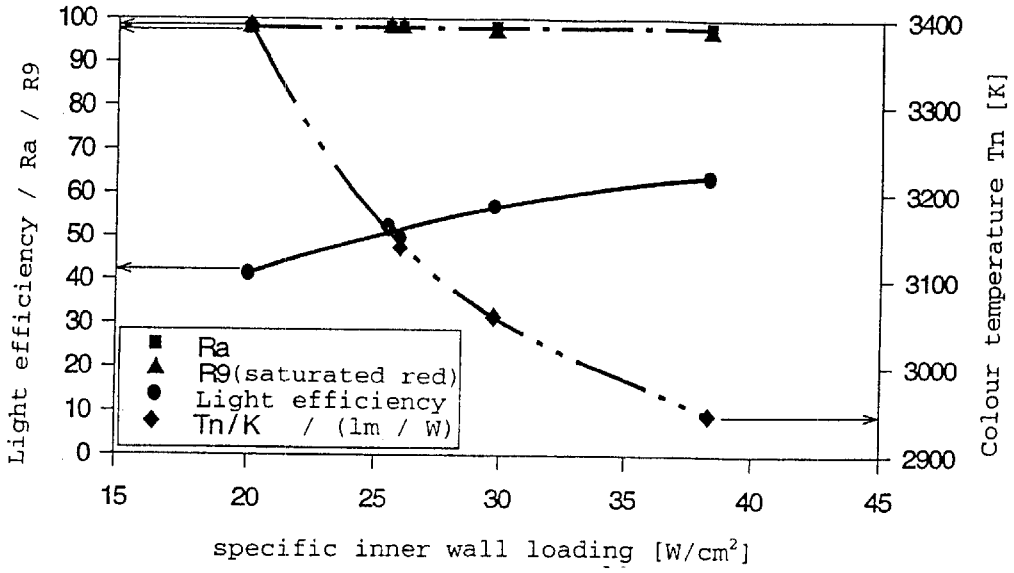
Figure 4:
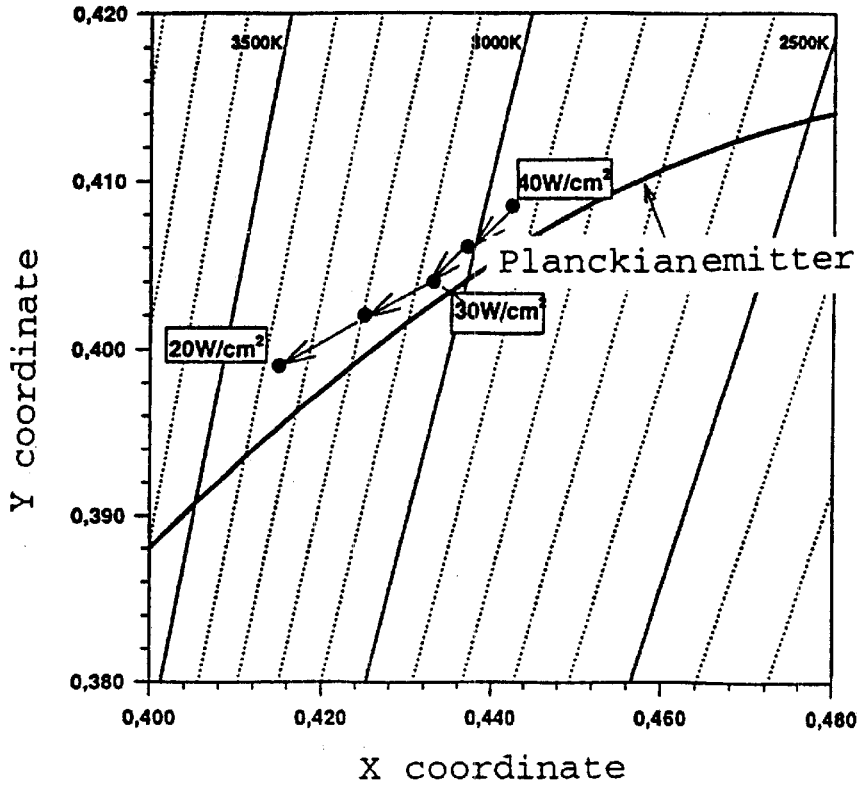

As shown in FIG. 3, the light efficiency is 50 lm/W. The colour rendering index Ra and the R9 value are just below 100. These very good values are independent of dimming down to 50% of full power, as can be seen from FIGS. 2 and 3, in which, as the dimming parameter, the wall loading varies between 20, 30 and 40 W/cm$^2$ (corresponding to a dimming level of 50%, 75% and 100%). Therefore, this lamp is eminently suitable as a replacement for incandescent lamps. The colour temperature $T_n$ can be varied continuously between 3400 and 2950 K by dimming. The change in colour coordinates x and y during dimming takes place almost exactly along the Planckian locus (FIG. 4). The correct amount of added TlI plays an important role in this. This discovery is extremely advantageous when compared with previous fills.

Figure 5:
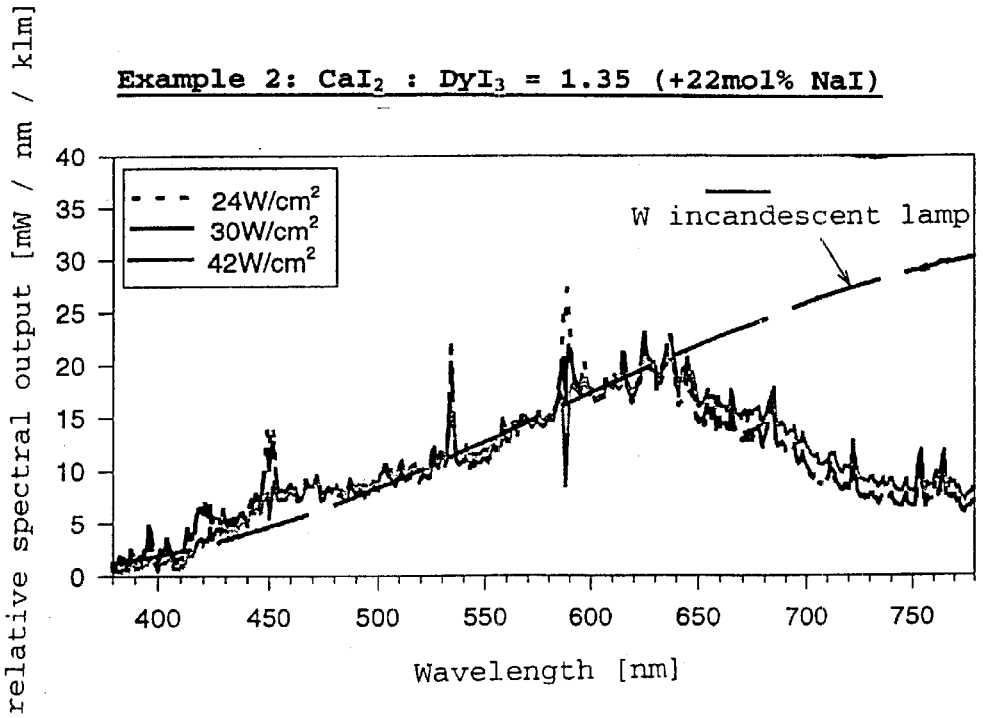
Figure 6:
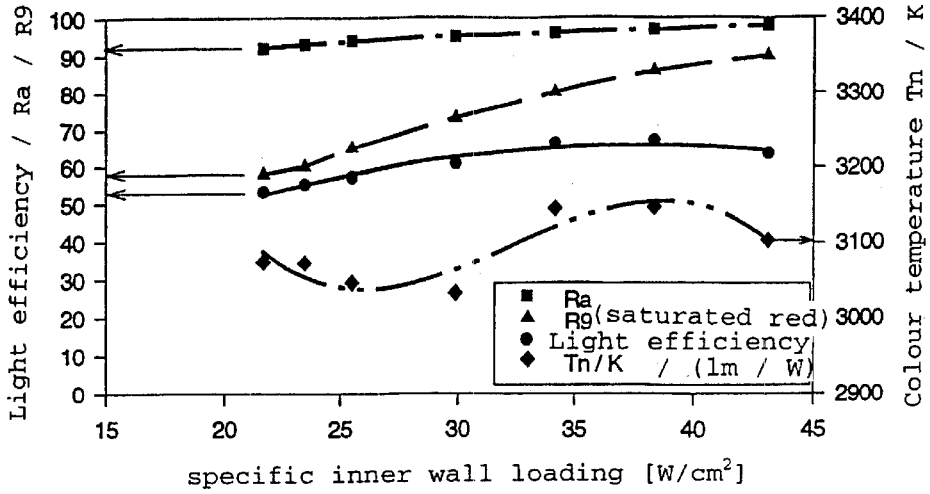
Figure 7:
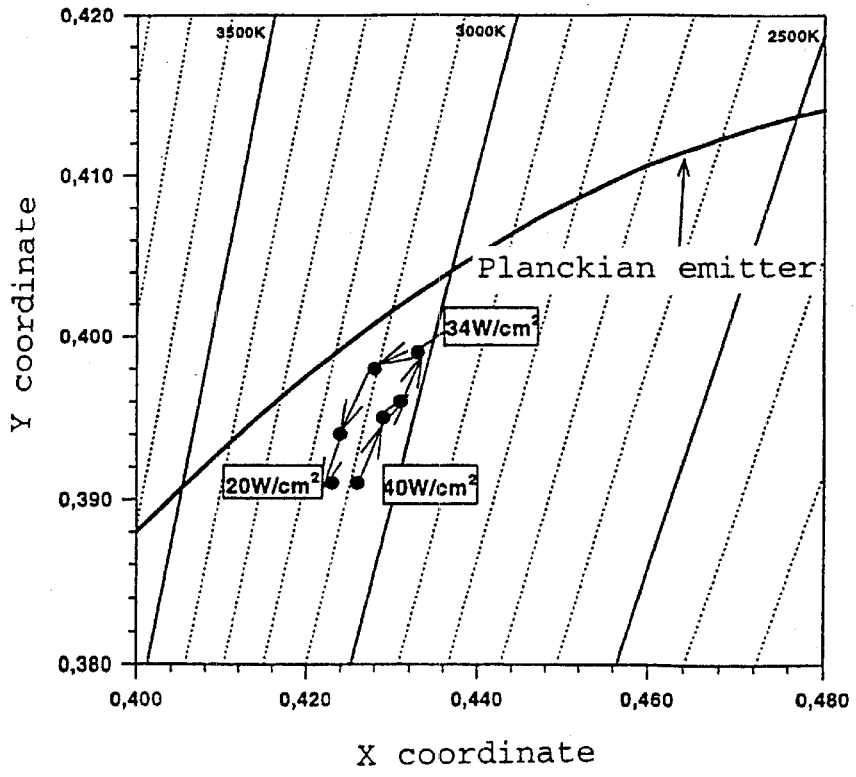

In the second exemplary embodiment, the spectrum of which is shown in FIG. 5, the operating voltage was 80 V. The molar ratio CaMH:DyMH=29:39=0.74. The R9 index varies between 60 and 85, as shown in FIG. 6, depending on the dimming, while the Ra was always significantly above 90; the colour temperature was almost constant at approximately 3100 K during dimming between 50 and 100%. With low-level dimming close to 50% (corresponding to a wall loading of 20 W/cm$^2$), the R9 value is about 50, but with high dimming up to 100% of the possible output (wall loading of typically 32 W/cm$^2$) is rather high, at 75 to 80. FIG. 7 shows the colour coordinates x and y.

Figure 10:
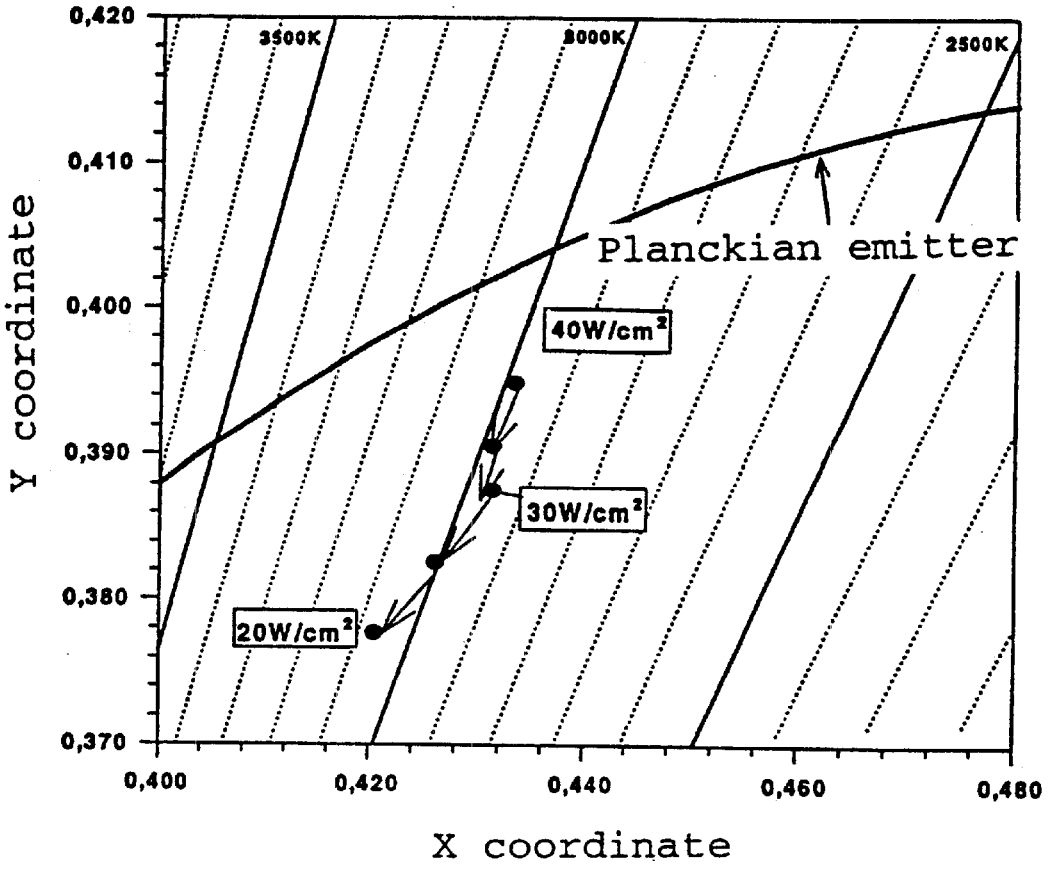

In a third exemplary embodiment, the spectrum of which is shown in FIG. 8, the operating voltage was 73 V. The molar ratio CaMH:DyMH=30:45=0.67. A mixture of InI and $HfBr_4$ was used to adapt the voltage. During dimming (FIG. 9) the performance is very stable: all the colour indices (Ra and R9) exhibit a virtually constant performance and are virtually independent of the dimming level. The red value R9 is well above 70, while the Ra is about 95. During dimming, the colour coordinates x and y (FIG. 10) lie at a constant colour temperature of approximately 3000 K.

In all the exemplary embodiments, the ratio of the internal longitudinal dimension to the internal lateral dimension of the discharge vessel, which forms an ellipsoid, was approximately 1.7. The internal axial length was 12 mm (interpreted as total length of the inscribed ellipse (illustrated in dashed lines in FIG. 1)) and the internal maximum diameter of the discharge vessel which bulges out in the shape of a circle, transversely with respect to the lamp axis, was 7 mm.

What is claimed is:

1. Mercury-free metal halide lamp with a warm white luminous colour and a high colour rendering index Ra, the lamp comprising a discharge vessel into which electrodes are introduced in a vacuum-tight manner and with an ionizable fill in the discharge vessel, characterized in that the fill comprises the following components:

an inert gas which acts as a buffer gas, a first group of metal halides (MH), the boiling point of which is over 1000° C., the first group comprising at least Dy and Ca used simultaneously as metals, and the molar ratio of the two metal halides Ca-MH:Dy-MH being between 0.1 and 10;

a second group of metal halides, the boiling point of which is below 1000° C., the second group comprising at least one of the elements In, Zn, Hf, Zr as metals;

the total fill quantity of the first group of metal halides being between 5 and 100 $\mu$mol/cm$^3$;

the total fill quantity of the second group of metal halides being between 1 and 50 $\mu$mol/cm$^3$;

the colour temperature being between 2700 and 3500 K;

the general colour rendering index being at least Ra=90, while at the same time the red rendering index is at least R9=60.

2. Mercury-free metal halide lamp according to claim 1, characterized in that the molar ratio of the two metal halides Ca-MH:Dy-MH is between 0.2 and 5.

3. Mercury-free metal halide lamp according to claim 1, characterized in that the second group additionally comprises a metal halide of Tl in an amount of up to 30 $\mu$mol/cm$^3$, preferably 5 to 25 $\mu$mol/cm$^3$.

4. Mercury-free metal halide lamp according to claim 1, characterized in that the first group also includes a metal halide of Na in a proportion of up to 30 mol %, preferably of at most 5 mol %, of the total quantity.

5. Mercury-free metal halide lamp according to claim 1, characterized in that the first group additionally comprises a metal halide of Cs in an amount of up to 40 $\mu$mol/cm$^3$, preferably 5 to 30 $\mu$mol/cm$^3$.

6. Mercury-free metal halide lamp according to claim 1, characterized in that the cold filling pressure of the inert gas is between 100 and 10,000 mbar.

7. Mercury-free metal halide lamp according to claim 1, characterized in that the members of the second group are additionally added as metals in a proportion of up to 30 mol %.

8. Mercury-free metal halide lamp according to claim 1, characterized in that at least one metal halide of the metals Al, Ga, Sn, Mg, Mn, Sb, Bi, Sc is additionally added to the second group, specifically in total in an additional proportion of up to 40 mol %.

9. Mercury-free metal halide lamp according to claim 1, characterized in that at least one metal halide of the metals Sr, Ba, Li and/or the rare-earth elements is additionally added to the first group, specifically in total in an additional proportion of up to 30 mol %.

10. Mercury-free metal halide lamp according to claim 1, characterized in that the preferably ceramic discharge vessel has a typical ratio between the maximum internal longitudinal and lateral dimensions of at most 3.5.

11. Mercury-free metal halide lamp according to claim 1, characterized in that the inner wall surface of the discharge vessel is dimensioned in such a way that a wall loading of 10–60 W/cm$^2$ prevails.

* * * * *